United States Patent [19]

Bouton

[11] 3,975,869

[45] Aug. 24, 1976

[54] SPORTS COMPLEX

[76] Inventor: James Bouton, 267 Maple St., Englewood, N.J. 07631

[22] Filed: Nov. 18, 1974

[21] Appl. No.: 524,917

[52] U.S. Cl. ..... 52/9; 52/64
[51] Int. Cl.[2] ..... E04H 3/12
[58] Field of Search ..... 52/7, 10, 6, 64, 9

[56] References Cited

UNITED STATES PATENTS

| | | | |
|---|---|---|---|
| 1,356,709 | 10/1920 | Gould | 52/10 |
| 1,433,547 | 10/1922 | Hadden | 52/9 |
| 3,002,234 | 10/1961 | Waterbury | 52/9 |
| 3,241,270 | 3/1966 | Newman | 52/10 |

FOREIGN PATENTS OR APPLICATIONS

| | | | |
|---|---|---|---|
| 1,359,710 | 3/1964 | France | 52/7 |
| 1,068,653 | 6/1954 | France | 52/6 |
| 124,122 | 8/1931 | Germany | 52/9 |
| 804,129 | 2/1951 | Germany | 52/6 |
| 1,213,591 | 3/1966 | Germany | 52/9 |

*Primary Examiner*—Ernest R. Purser
*Assistant Examiner*—Henry Raduazo
*Attorney, Agent, or Firm*—Blum, Moscovitz, Friedman & Kaplan

[57] ABSTRACT

A sports or stadium complex having movable stands to define different playing fields for different sports with stands substantially surrounding same is provided. The sports complex includes a plurality of stationary stands, and a second plurality of movable stands, each of said movable stands being adapted to move from a first position wherein each of said stationary stands and said movable stands are positioned with respect to each other to define a first playing field with stands substantially surrounding same to a second position, movement of at least one of said movable stands to a second position defining a playing field for a second sport and stands substantially surrounding same.

8 Claims, 8 Drawing Figures

SPORTS COMPLEX

BACKGROUND OF THE INVENTION

This invention is directed to a sports complex capable of defining playing fields for different sports, and in particular to the use of a plurality of movable stands for allowing different sporting events to be played within a short time in a single sports complex.

The recent proliferation of sporting franchises in baseball, football, basketball, hockey, etc. have placed sports franchises in cities which lack stadiums and/or indoor arenas necessary to accommodate franchises of different sports. Accordingly, outdoor stadiums have been built to accommodate football and baseball teams, but because of the different shapes of the field utilized to play both sports, it has been difficult to provide stands which substantially surround the football field for football and a baseball field for baseball.

This problem has led to the building of separate stadiums such as in Kansas City, Missouri, wherein separate stadiums for football and baseball were built in order to optimize the view that spectators would have of the playing fields. An alternate approach has been the recent development of domed stadiums, such as the Astrodome in Houston, Texas, which has been utilized for such diverse sporting events as baseball, football, basketball and tennis. Nevertheless, because of the lack of mobility in the stands, the indoor events in such domed arenas have been less than completely satisfactory due to the inability to bring the stands closer to the playing field.

SUMMARY OF THE INVENTION

Generally speaking, in accordance with the invention, a sports complex capable of providing several playing fields for different sports and stands substantially surrounding same is provided. A sports complex includes a plurality of stationary stands and a second plurality of movable stands, each of said movable stands being adapted to be moved from a first position wherein each of the stationary stands and movable stands are positioned with respect to each other to define a first playing field with stands substantially surrounding same to a second position, movement of at least one of said second stands to a second position defining a second playing field with stands substantially surrounding same.

Accordingly, it is an object of this invention to provide an improved sports complex particularly suited for different sports.

Another object of this invention is to provide an improved sports complex wherein stationary stands and movable stands are provided, movement of the stands defining different fields for staging different sporting events.

Still another object of this invention is to provide an improved sports complex wherein each sport played therein offers the spectators the best possible view in that the spectators are positioned as close as possible to the playing field.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
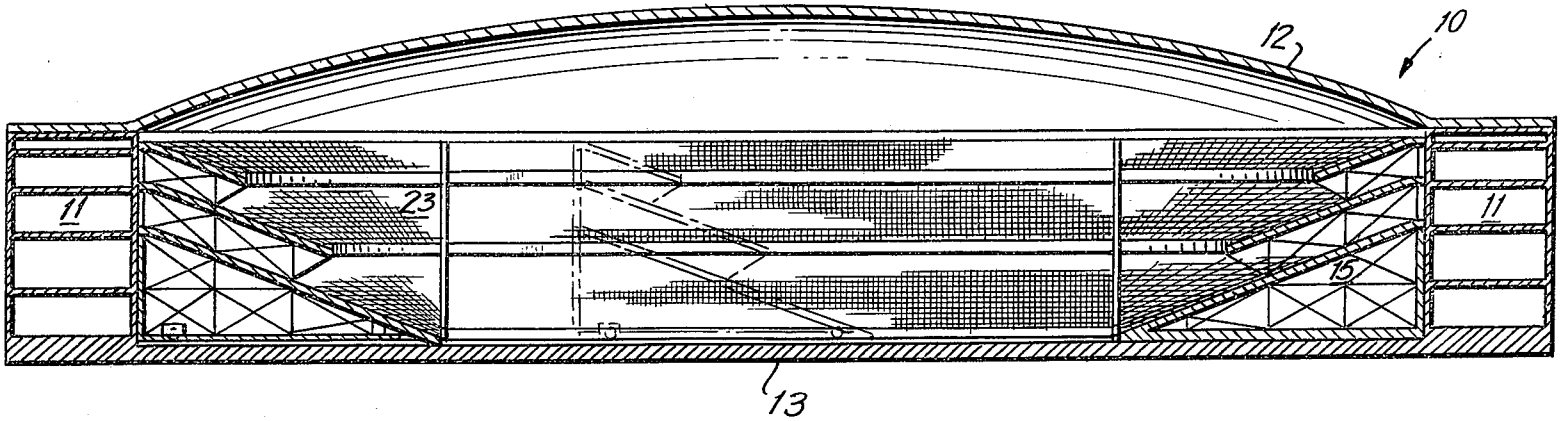
FIG. 1 is a sectional view of a domed sports complex constructed in accordance with the instant invention, and taken along line 1—1 of FIG. 2.
Figure 2:
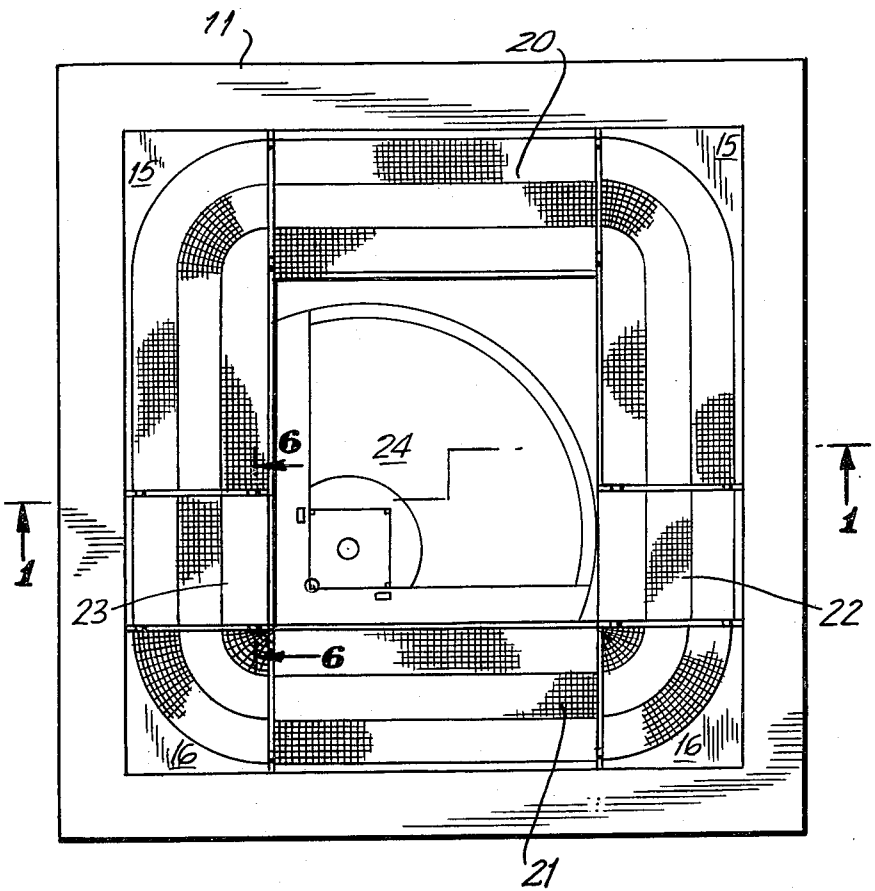
FIG. 2 is a plan view of a sports complex defining a baseball field and stands substantially surrounding same constructed in accordance with the instant invention.

Reference is now made to FIGS. 1 and 2, wherein a domed sports complex, generally indicated at 10, for staging a plurality of sporting events is depicted. The sports complex includes outer wall construction 11 which defines outer walls of the sports complex and is utilized for providing walkways for the stands and concessions within the sports complex. The outer wall is constructed in combination with the bottom wall 13 and dome 12 to define an enclosed stadium completely protected from the weather. Of course, the invention is not limited to an indoor complex.

The bottom 13 of the stadium supports rectangular stationary stands 15, square stationary stands 16, movable rectangular stands 20 and 21 and movable square stands 22 and 23. As is specifically depicted in FIG. 2, the movable stands are aligned with the stationary stands to define a baseball field 24. Moreover, the stands substantially surround the baseball field to provide viewing of the field from as close as possible.

Movable stands 20 through 23 are adapted to selectively move from a first position related to said fixed stands for baseball viewing to other positions related to said fixed stands for viewing other sports.

Figure 6:
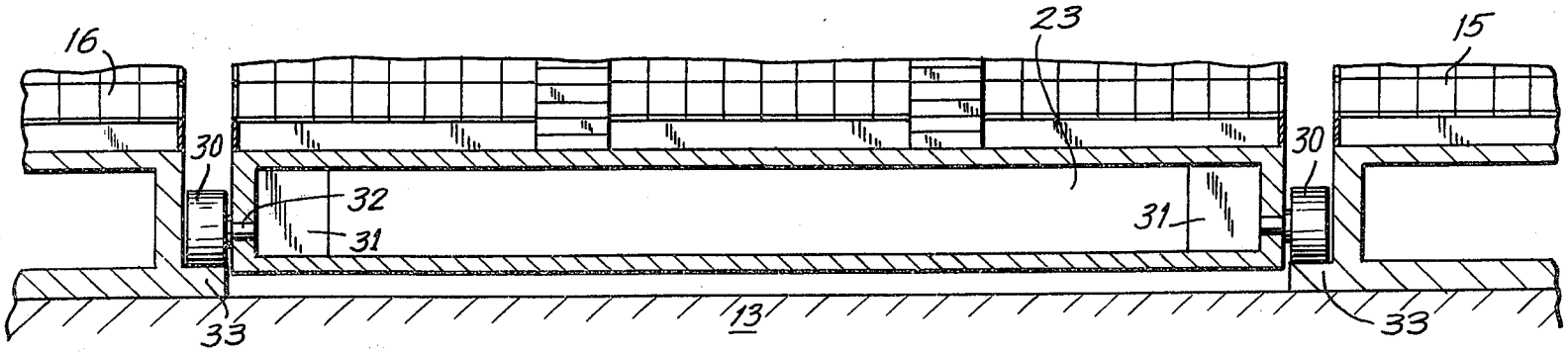
FIG. 6 is a partial sectional view taken along line 6—6 of FIG. 2.
Figure 7:
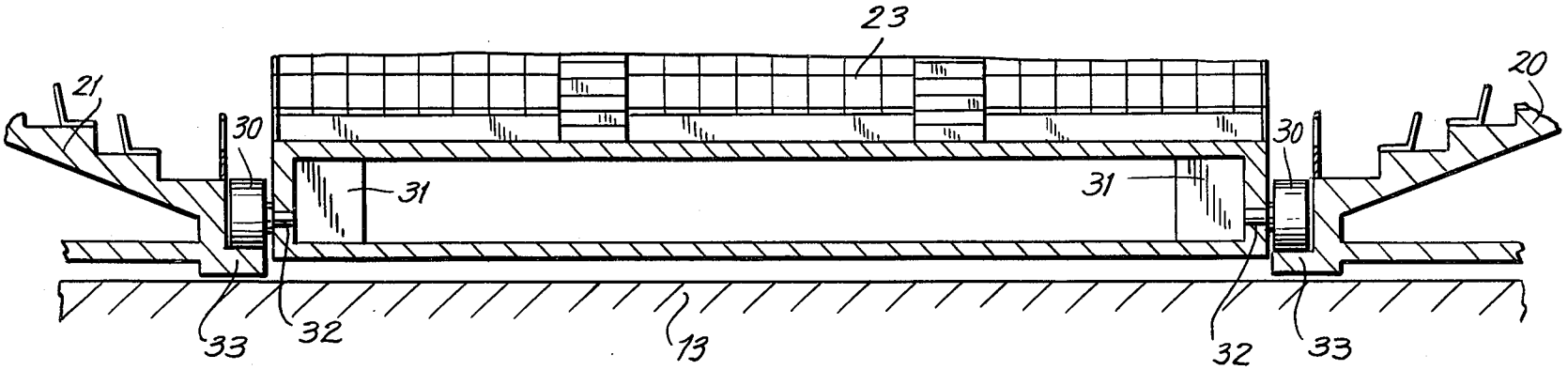
FIG. 7 is a partial sectional view taken along line 7—7 of FIG. 4.
Figure 8:
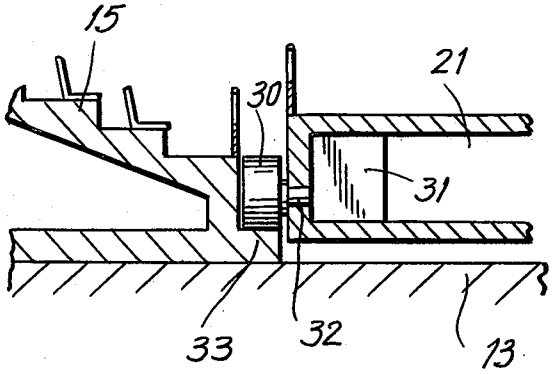
FIG. 8 is a partial sectional view taken along line 8—8 of FIG. 3.

While the stands constructions and movement means may vary widely, a form of movement means is shown in FIGS. 6 – 8 for better understanding. Each movable section of stands includes a motor 31 coupled to a roller 30 by a shaft 32 in order to drive the roller 30 and effect a displacement of the movable stands along the track defined by latitudinal projections 33. Each longitudinal and transverse extent of the rectangular stationary stands 15 and square stationary stands 16 having a section of movable stands adjacent thereto includes a lateral projection 33 for defining a track. As is clearly depicted in FIG. 6, if it is desired to displace movable stands 23 to an inward position, it is first necessary to displace movable stands 20 to the inner position depicted in FIGS. 4 and 5 to thereby provide tracks for inwardly displacing movable stands 23. Accordingly, driving rollers 30 along the projections 33 of the stationary stands and movable stands 20 and 21 thereby effects movement of said stands in a straight line. The latitudinal projection 33 defining the track on which the rollers are provided is also included on each of the internal facing sides of the movable stands to thereby provide tracks for the other movable stands.

Figure 3:
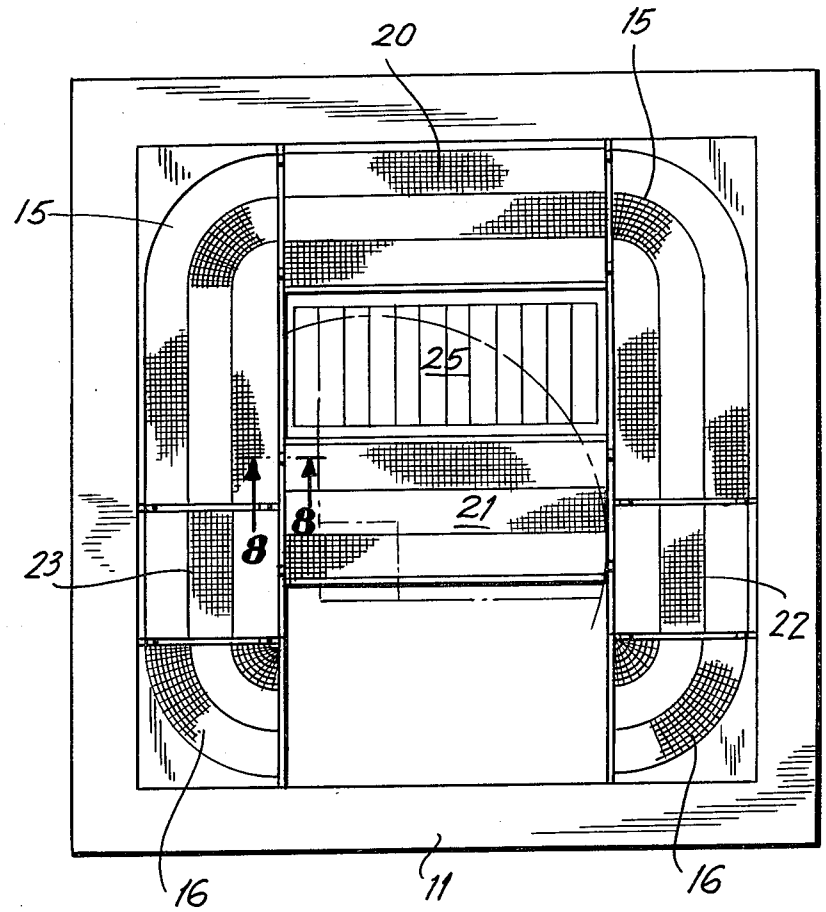
FIG. 3 is a plan view of the sports complex defining a football field and stands substantially surrounding same in accordance with the instant invention.

In operation, if the change from baseball to football is desired, movable stands 21 are displaced from the position illustrated in FIG. 2 to the position indicated in FIG. 3. Accordingly, a stadium particularly suited for football wherein the stands substantially and closely surround football field 25 thereby bring the spectators closer to the sporting event hence, improving their view of the football game.

Figure 5:
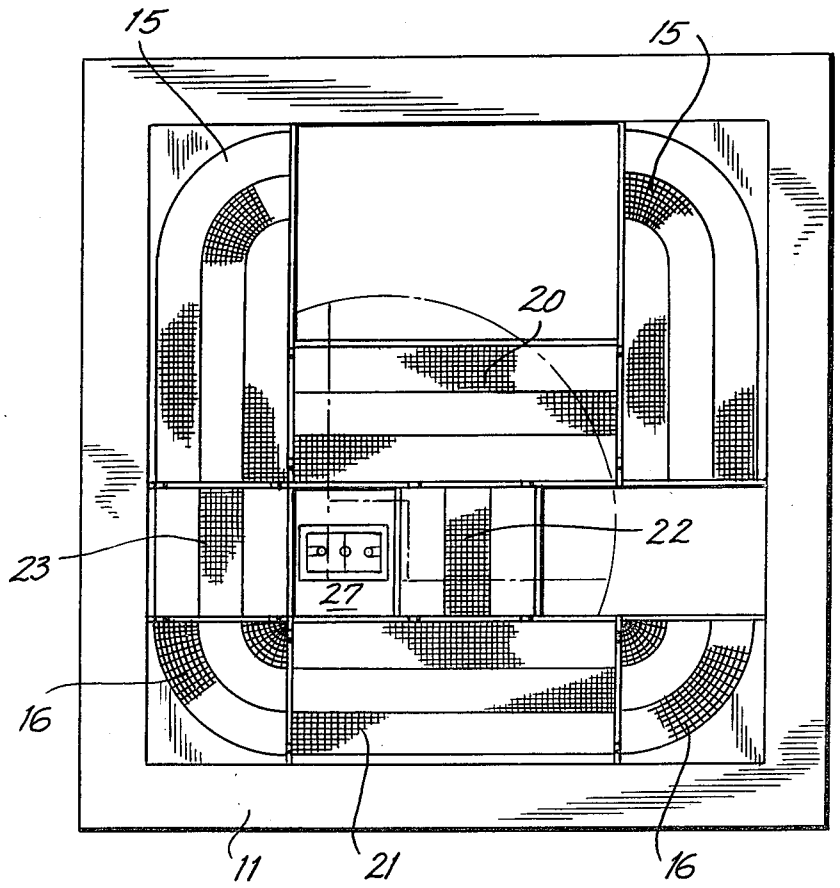
FIG. 5 is a plan view of the sports complex defining a basketball court and stands substantially surrounding same constructed in accordance with the instant invention.
Figure 4:
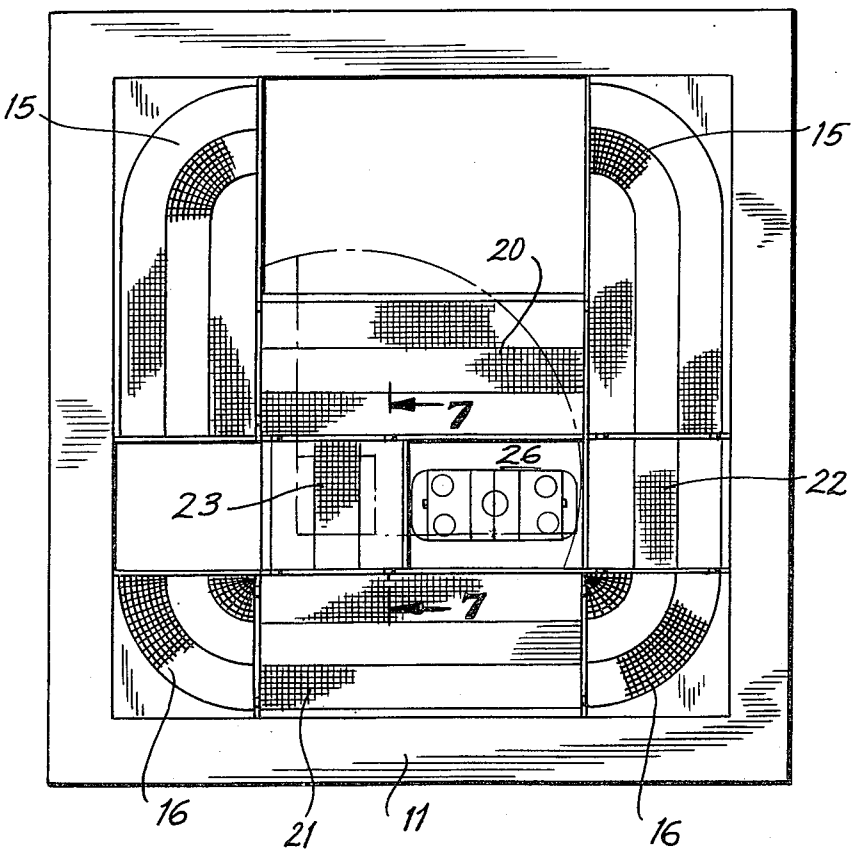
FIG. 4 is a plan view of the sports complex defining a hockey arena and stands substantially surrounding same constructed in accordance with the instant invention.

Referring to FIGS. 4 and 5, two further possibilities are illustrated. If a hockey game is to be staged, by moving movable stands 20 into a second position, movable stands 20 and movable stands 21 which remain in alignment position with the stationary stands define tracks on which movable stands 23 can be moved in order to define a hockey rink 26 wherein spectators are brought into proximity with the hockey rink. Similarly, if a basketball game is scheduled it is only necessary to maintain movable stands 20 in the second position, and to displace movable stands 22 to a second inward position to thereby define a basketball court with stands substantially surrounding same. It is noted that other events such as track meets, tennis matches, etc. can be scheduled in the arenas provided by the hockey and basketball stands and that the hockey rink 26, basketball court 27, football field 25 and baseball diamond 24 are merely examples of four different and distinct sporting fields obtainable by utilizing the novel sports complex disclosed herein.

Such a sports complex has substantial commercial value in maximizing utilization of expensive arenas. The arrangements of stands can be rapidly changed for scheduling multiple events on the same day. The current draw-back of Madison Square Garden, for example, which requires the placement of boards over the ice to change from hockey to basketball is completely eliminated.

While the foregoing description has emphasized sports, as sports interests are usually the driving force behind construction of an arena or stadium, the complex heretofore described has limitless uses and can be properly used whenever large groups of people are to assemble.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A stadium complex having four stationary stands and four movable stands combined to surround a field of maximum area when in a first position, two of said stationary stands being in facing relationship on opposite sides of an imaginary line passing longitudinally through said field, and being of substantially equal longitudinal extent, the other two of said stationary stands also being in facing relationship on opposite sides of said longitudinal line and also being of substantially equal longitudinal extent but of lesser extent than said first two stationary stands, two of said movable stands being in facing relationship on opposite sides of an imaginary line passing transversely through said field and being of substantially equal transverse extent, one of said two movable stands in said first position being located between said first two stationary stands and the other of said two movable stands being located between said other two stationary stands, and said other two movable stands being in facing relationship with each being positioned, in said first position, between a stationary stand of longitudinal extent and a stationary stand of lesser longitudinal extent.

2. A stadium complex comprising a central area surrounded by a plurality of stationary and movable stands in a first position, said stands comprising a first stationary stand of longitudinal extent, a first movable stand of longitudinal extent longitudinally contiguous said first stationary stand, a second stationary stand of lesser longitudinal extent as compared with said first stationary stand, said second stationary stand being longitudinally contiguous said first movable stand, a third stationary stand spaced from and facing said second stationary stand, a second movable stand spaced from and facing said first movable stand, a fourth stationary stand spaced from and facing said first stationary stand, said third stationary stand, second movable stand and fourth stationary stand all being of longitudinal extent with said facing stands being respectively of substantially equal longitudinal extent, said second movable stand being contiguous and between said third and fourth stationary stands, a third movable stand of lateral extent extending between said second and third stationary stands, and a fourth movable stand of lateral extent extending between said first and fourth stationary stands and being spaced from said third movable stand, whereby said stands, in said first position define therebetween a field of maximum area.

3. A stadium complex as claimed in claim 2, wherein said field in said first position is suitable for play thereon of the game of baseball.

4. A stadium complex as claimed in claim 2, wherein said third movable stand is movable toward said fourth movable stand to define a second position forming a field suitable for play thereon of the game of football.

5. A stadium complex as claimed in claim 2, wherein said fourth movable stand is movable toward said third movable stand and one of said first and second movable stands is movable toward the other to define a third position forming a field suitable for play thereon of games requiring smaller field areas including basketball and hockey.

6. A stadium complex as claimed in claim 2, wherein each of said movable and stationary stands include means peripherally disposed therebetween for moving said movable stands from a first position to a second position.

7. A stadium complex as claimed in claim 6, wherein said means for movably displacing said movable stands includes a track disposed on said stationary stands and rollers coupled to said movable stands disposed to roll on said tracks.

8. A stadium complex as claimed in claim 7, movable stands include a track on the surface thereof defining the periphery of the field of maximum area, said tracks on said movable stands further defining means for enabling said movable stands to be moved from a first to a second position.

* * * * *